US009056466B2

(12) United States Patent
Wanibe et al.

(10) Patent No.: US 9,056,466 B2
(45) Date of Patent: Jun. 16, 2015

(54) HEAD UNIT HAVING ELECTRICAL CIRCUIT SUBSTRATE AND IMAGE RECORDING DEVICE INCLUDING HEAD UNIT

(71) Applicant: SEIKO EPSON CORPORATION, Tokyo (JP)

(72) Inventors: Akihisa Wanibe, Nagano (JP); Jun Shimazaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/444,428

(22) Filed: Jul. 28, 2014

(65) Prior Publication Data

US 2015/0077473 A1 Mar. 19, 2015

(30) Foreign Application Priority Data

Sep. 19, 2013 (JP) ..... 2013-193896

(51) Int. Cl.

| | |
|---|---|
| ***B41J 2/16*** | (2006.01) |
| ***B41J 2/14*** | (2006.01) |
| ***B41J 2/175*** | (2006.01) |
| ***B41J 29/377*** | (2006.01) |

(52) U.S. Cl.

CPC ..... *B41J 2/14* (2013.01); *B41J 2002/14491* (2013.01); *B41J 2/14072* (2013.01); *B41J 2/175* (2013.01); *B41J 29/377* (2013.01); *B41J 2202/12* (2013.01); *B41J 2202/19* (2013.01); *B41J 2202/20* (2013.01)

(58) Field of Classification Search

USPC ..... 347/50, 58, 59, 65

See application file for complete search history.

(56) References Cited

U.S. PATENT DOCUMENTS

| | | | | |
|---|---|---|---|---|
| 2004/0240177 | A1 | 12/2004 | Suzuki et al. | |
| 2005/0157076 | A1 * | 7/2005 | Silverbrook et al. | 347/50 |
| 2013/0258018 | A1 * | 10/2013 | Nakajima et al. | 347/102 |

FOREIGN PATENT DOCUMENTS

| | | | |
|---|---|---|---|
| JP | 2005-011304 | A | 1/2005 |
| JP | 2007-223196 | A | 9/2007 |

* cited by examiner

*Primary Examiner* — Henok Legesse

(74) *Attorney, Agent, or Firm* — Global IP Counselors, LLP

(57) ABSTRACT

An electrical circuit substrate, a first holding member holding the electrical circuit substrate, a head configured to discharge liquid, a flow path member having a flow path in which flows the liquid supplied to the head, and a second holding member holding the head and the flow path member are provided. The first holding member and the second holding member are detachably attached with each other.

14 Claims, 5 Drawing Sheets

HEAD UNIT HAVING ELECTRICAL CIRCUIT SUBSTRATE AND IMAGE RECORDING DEVICE INCLUDING HEAD UNIT

CROSS-REFERENCE TO RELATED APPLICATIONS

This application claims priority to Japanese Patent Application No. 2013-193896 filed on Sep. 19, 2013. The entire disclosure of Japanese Patent Application No.2013-193896 is hereby incorporated herein by reference.

BACKGROUND

1. Technical Field

The present invention relates to a head unit equipped with a head, a flow path member, and an electrical circuit substrate, and to an image recording device equipped with that head unit.

2. Related Art

With Unexamined Patent Publication No. 2007-223196, noted is a constitution with which ink is supplied to a head using an ink flow path forming member for which the ink flow path is formed on the interior. The ink flow path forming member and the head are supported on a common support substrate. Furthermore, this support substrate also supports an electrical circuit substrate of an ICB substrate and a relay substrate. In other words, with Unexamined Patent Publication No. 2007-223196, the head, the flow path member, and the electrical circuit substrate are supported on a common support substrate.

However, because ink or the like is supplied to the head and the flow path member, it is preferable to perform appropriate maintenance on these. However, with Unexamined Patent Publication No. 2007-223196, during maintenance of the head and the flow path member, the electrical circuit substrate supported on the support substrate together with these becomes an obstacle. Because of that, the head and flow path member maintenance work efficiency was not good.

SUMMARY

This invention was created considering the problems noted above, and a goal is to provide technology making it possible to increase the efficiency of maintenance work on the head and the flow path member with a head unit equipped with a head, a flow path member, and an electrical circuit substrate, and an image recording device equipped with that head.

To achieve the object noted above, the head unit of the invention is equipped with an electrical circuit substrate, a first holding member holding the electrical circuit substrate, a head configured to discharge liquid, a flow path member having a flow path in which flows the liquid supplied to the head, and a second holding member holding the head and the flow path member. The first holding member and the second holding member are detachably attached with each other.

To achieve the object noted above, the image recording device of the invention is equipped with a support unit configured to support a recording medium and a head unit configured to discharge liquid on the recording medium supported by the support unit. The head unit is equipped with an electrical circuit substrate, a first holding member holding the electrical circuit substrate, a head configured to discharge liquid, a flow path member having a flow path in which flows the liquid supplied to the head, and a second holding member holding the head and the flow path member. The first holding member and the second holding member are detachably attached with each other.

With the invention (head unit, image recording device) constituted in this way, the electrical circuit substrate is held in the first holding member, and the head and the flow path member are held in the second holding member. Also, the first holding member and the second holding member can be attached and detached with each other. Therefore, it is possible to separate the first holding member and the second holding member from each other, and to pull away the head and the flow path member held in the second holding member from the electrical circuit substrate held in the first holding member. As a result, it is possible to perform maintenance on the head and the flow path member without interference by the electrical circuit substrate, and there is an improvement in efficiency of maintenance work on the head and the flow path member.

It is also possible to constitute the head unit such that at least one of the head and the flow path member is detachably held by the second holding member. With that constitution, it is possible to separate the head and the flow path member from each other, and it is possible to execute maintenance of one without interference by the other. Therefore, this is suitable for improving the efficiency of maintenance work on the head and the flow path member.

The head unit can also be constituted being equipped with a connecting member connecting the electrical circuit substrate and the head, and configured to transmit electrical signals from the electrical circuit substrate to the head. The connecting member is detachably attached with at least one of the head and the electrical circuit substrate. With that constitution, the connecting member that connects the electrical circuit substrate and the head is detachable with at least one of the head and the electrical circuit substrate. Therefore, by removing the connecting member from one of these, it is possible to separate the first holding member and the second holding member from each other, and to pull away the head and the flow path member held in the second holding member from the electrical circuit substrate held in the first holding member.

It is also possible to constitute the head unit so as to have an attachment member configured to engage with the first holding member and the second holding member and the attachment member is a screw that fastens the first holding member and the second holding member. With this constitution, by removing the screw, it is possible to easily remove the first holding member and the second holding member.

It is also possible to constitute the head unit such that the flow path member is a manifold or a tube.

It is also possible to have the liquid be cured by light irradiation. In other words, in this case, it is possible that liquid cured due to leaked light or the like will adhere to the head and the flow path member. In response to this, with the invention, it is possible to easily perform maintenance on the head and the flow path member, making it possible to suitably handle the problem of liquid becoming adhered.

It is also possible to constitute the head unit such that in a state where the first holding member and the second holding member are engaged, the first holding member at least partially hides the flow path member. In other words, with that constitution, in a state with the second holding member and the first holding member engaged, it is possible to have a case for which the flow path member is hidden by the first holding member, so that maintenance on the flow path member cannot be performed efficiently. In response to this, with the invention, by separating the first holding member and the second holding member, it is possible to pull away the flow path member from the first holding member. As a result, it is possible to efficiently perform maintenance work on the flow path member without interference by the first holding member.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
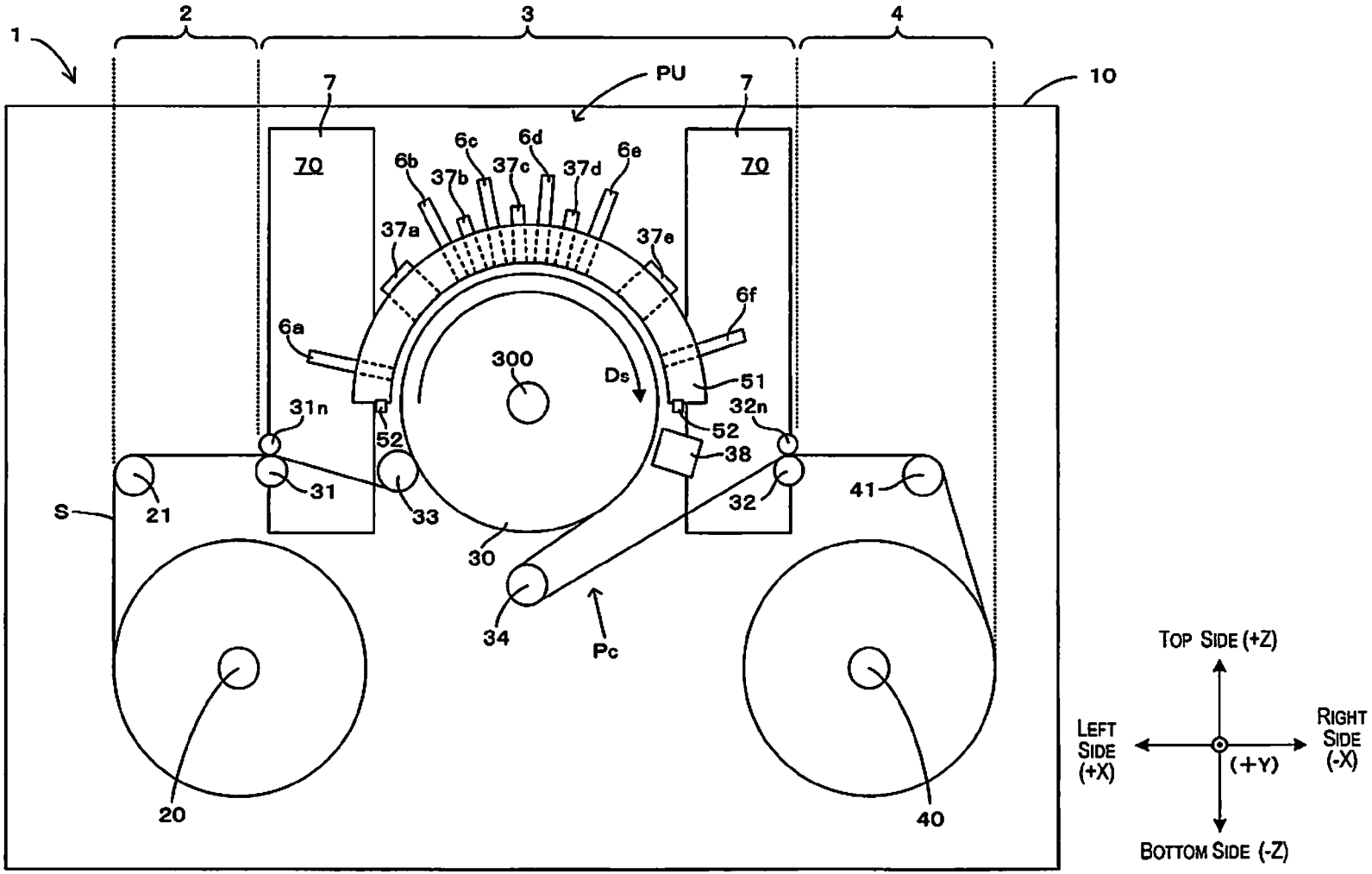
FIG. 1 is a front view showing a typical example of the schematic constitution of a printer to which the present invention can be applied.

FIG. 1 is a front view showing a typical example of the schematic constitution of a printer to which the present invention can be applied. With FIG. 1 and the drawings hereafter as necessary, to clarify the arrangement relationship of each of the parts of the device, an XYZ orthogonal coordinate system is displayed corresponding to the left and right direction X, front and back direction Y, and vertical direction Z of a printer 1.

As shown in FIG. 1, with the printer 1, one sheet S (web) for which both ends are wound in roll form on a feed shaft 20 and a take-up shaft 40 is stretched along a conveyance path Pc, and the sheet S undergoes image recording while being conveyed in a conveyance direction Ds facing from the feed shaft 20 to the take-up shaft 40. The sheet S types are roughly divided into paper and film. To list specific examples, for paper, there is high quality paper, cast coated paper, art paper, coated paper and the like, and for film, there is synthetic paper, PET (Polyethylene terephthalate), PP (polypropylene) and the like. Schematically, the printer 1 is equipped with a feed unit 2 (feed area) that feeds the sheet S from the feed shaft 20, a processing unit 3 (processing area) that records an image on the sheet S fed from the feed unit 2, and a take-up unit 4 (take-up area) that takes up the sheet S on which the image is recorded by the processing unit 3 by the take-up shaft 40, wherein these functional units 2, 3, and 4 aligned in the X direction are housed in a housing 10. With the description hereafter, of the two surfaces of the sheet S, the surface on which the image is recorded is called the front surface, and the reverse side surface to that is called the back surface.

The feed unit 2 has the feed shaft 20 on which the end of the sheet S is wound, and a driven roller 21 that winds the sheet S pulled from the feed shaft 20. In a state with the front surface of the sheet S facing the outside, the feed shaft 20 winds and supports the sheet S. Also, by rotating the feed shaft 20 clockwise at the paper surface in FIG. 1, the sheet S wound on the feed shaft 20 is fed via the driven roller 21 to the processing unit 3. Incidentally, the sheet S is wound on the feed shaft 20 via a core tube (not illustrated) that can be attached and detached with the feed shaft 20. Therefore, when the sheet S of the feed shaft 20 is used up, a new core tube on which the sheet S is wound in roll form is mounted on the feed shaft 20, making it possible to replace the sheet S of the feed shaft 20.

The processing unit 3 performs processing as appropriate using a process unit PU arranged along the outer circumference surface of a rotating drum 30 while supporting the sheet S fed from the feed unit 2 on the rotating drum 30, and prints an image on the sheet S. With this processing unit 3, a front drive roller 31 and a rear drive roller 32 are provided at both sides of the rotating drum 30, the sheet S conveyed from the front drive roller 31 to the rear drive roller 32 is supported on the rotating drum 30, and it undergoes image printing.

The front drive roller 31 has a plurality of minute projections formed by thermal spraying on the outer circumference surface, and the sheet S fed from the feed unit 2 is wound from the back surface side. Also, by the front drive roller 31 rotating clockwise on the paper surface of FIG. 1, the sheet S fed from the feed unit 2 is conveyed to the downstream side of the conveyance path. A nip roller 31*n* is provided on the front drive roller 31. This nip roller 31*n* abuts the front surface of the sheet S in a state biased to the front drive roller 31 side, and the sheet S is sandwiched between it and the front drive roller 31. By doing this, frictional force is ensured between the front drive roller 31 and the sheet S, and it is possible to reliably perform conveying of the sheet S by the front drive roller 31.

The rotating drum 30 is a cylindrical shaped drum having a center line parallel to the Y direction, and the sheet S is wound on its outer circumference surface. Furthermore, the rotating drum 30 has a rotating shaft 300 that extends in the axial direction through the center line of the cylindrical shape. The rotating shaft 300 is supported to be able to rotate by a support mechanism that is not illustrated, and the rotating drum 30 rotates with the rotating shaft 300 as the center.

On the outer circumference surface of this kind of rotating drum 30, the sheet S conveyed from the front drive roller 31 to the rear drive roller 32 is wound from the back surface side. Also, the rotating drum 30 receives friction force with the sheet S, and the sheet S is supported from the back surface side while doing following rotation in the conveyance direction Ds of the sheet S. Incidentally, with the processing unit 3, driven rollers 33 and 34 that fold back the sheet S are provided at both sides of the winding part onto the rotating drum 30. Of these, the driven roller 33 winds the front surface of the sheet S between the front drive roller 31 and the rotating drum 30, and folds back the sheet S. Meanwhile, the driven roller 34 winds the front surface of the sheet S between the rotating drum 30 and the rear drive roller 32, and folds back the sheet S. In this way, by folding back the sheet S respectively at the upstream and downstream side of the conveyance direction Ds in relation to the rotating drum 30, it is possible to ensure a long winding part of the sheet S onto the rotating drum 30.

The rear drive roller 32 has a plurality of minute projections formed using thermal spraying on the outer circumference surface, and the sheet S conveyed via the drive roller 34 from the rotating drum 32 is wound from the back surface side. Also, by the rear drive roller 32 rotating clockwise on the paper surface in FIG. 1, the sheet S is conveyed to the take-up unit 4. A nip roller 32*n* is provided on the rear drive roller 32. This nip roller 32*n* abuts the front surface of the sheet S in a state biased to the rear drive roller 32 side, and the sheet S is sandwiched between it and the rear drive roller 32. By doing this, friction force between the rear drive roller 32 and the sheet S is ensured, and it is possible to reliably perform conveyance of the sheet S by the rear drive roller 32.

In this way, the sheet S conveyed from the front drive roller 31 to the rear drive roller 32 is supported on the outer circumference surface of the rotating drum 30. Also, with the processing unit 3, the process unit PU is provided for printing a color image on the front surface of the sheet S supported on the rotating drum 30. This process unit PU has a constitution with which head units 6*a* to 6*f*, UV irradiators 37*a* to 37*e*, and an ink supply system 7 are supported by a carriage 51.

The six head units 6*a* to 6*f* aligned in sequence in the conveyance direction Ds correspond to white, yellow, cyan, magenta, black, and clear (transparent), and discharge ink of corresponding colors from nozzles using the inkjet method. Each head unit 6*a* to 6*f* has a constitution with a discharge head 60 described later using FIG. 2 attached to the tip, and ink is discharged from a plurality of nozzles aligned in the Y direction on the discharge head 60. These six head units 6*a* to 6*f* are arranged in radiating form from the rotating shaft 300 of the rotating drum 30, and are aligned along the outer circumference surface of the rotating drum 30. Also, each head unit 6*a* to 6*f* is aligned in relation to the rotating drum 30 by the carriage 51, and faces opposite the rotating drum 30 with a slight clearance (paper gap) opened. By doing this, each head unit 6*a* to 6*f* faces opposite the front surface of the sheet S wound on the rotating drum 30 with a designated paper gap opened. By each head unit 6*a* to 6*f* discharging ink in a state with a paper gap regulated by the carriage 51 in this way, ink impacts desired positions on the front surface of the sheet S, and a color image is formed on the front surface of the sheet S.

Incidentally, the head unit 6*a* that discharges white ink is used for forming a white background on the sheet S when printing an image on a transparent sheet S. In specific terms, the head unit 6*a* forms a background by discharging white ink so as to completely fill in the entire surface of the area subject to image formation. Also, the head units 6*b* to 6*e* that discharge yellow, cyan, magenta, and black ink form a color image overlapping the white background. Also, the head unit 6*f* discharges clear ink overlapping the color image, so the color image is covered by clear ink. This gives a qualitative feel such as a glossy feel or matte feel or the like to the color image.

As the ink used with the head units 6*a* to 6*f*, UV (ultraviolet) ink that is cured by the irradiation of ultraviolet rays (light) (photocurable ink) is used. In light of that, to cure the ink and fix the ink on the sheet S, UV irradiators 37*a* to 37*e* are provided. This ink curing is executed with use divided between main curing and temporary curing. Here, main curing is the process of curing ink to the degree that wetting and spreading of the ink is stopped by irradiating ultraviolet rays of a relatively strong irradiation strength on the ink, and temporary curing is the process by which, by irradiating ultraviolet rays of relatively weak irradiation strength on the ink, ink is cured to a degree at which the ink wetting and spreading mode is sufficiently slow compared to when ultraviolet rays are not irradiated, and does not do main curing of the ink.

In specific terms, the UV irradiator 37*a* for main curing is arranged between the white head unit 6*a* and the cyan head unit 6*b*. Therefore, the white background formed by the head unit 6*a* receives ultraviolet rays from the UV irradiator 37*a* to undergo main curing before ink from the head units 6*b* to 6*f* is overlapped. The UV irradiators 37*b* to 37*d* for temporary curing are arranged between the yellow, cyan, magenta, and black head units 6*b* to 6*e*. Therefore, the ink discharged respectively by the head units 6*b* to 6*d* receive ultraviolet rays from the UV irradiators 37*b* to 37*d* and undergo temporary curing before ink from the head units 6*c* to 6*e* of the downstream side of the conveyance direction Ds is overlapped. By doing this, the occurrence of color mixing, which is the mixing of inks discharged respectively from the head units 6*b* to 6*e*, is suppressed. The UV irradiator 37*e* for main curing is arranged between the black head unit 6*e* and the clear head unit 6*f*. Therefore, the color image formed by the head units 6*b* to 6*e* receives ultraviolet rays from the UV irradiator 37*e* and undergoes main curing before ink from the head unit 6*f* is overlapped.

Also, two ink supply systems 7 are aligned in the X direction and attached on the back side (−Y side) of the carriage 51. The left side (+X side) ink supply system 7 has a constitution with which there is a mechanism for supplying white, yellow, and cyan ink (ink flow control mechanism) for each color and is housed in a housing 70, and supplies ink of colors corresponding to the three respective head units 6*a*, 6*b*, and 6*c*. The right side (−X side) ink supply system 7 has a constitution for which there is a mechanism for supplying magenta, black, and clear ink (ink flow control mechanism) for each color and is housed in the housing 70, and supplies ink of colors corresponding to the three respective head units 6*d*, 6*e*, and 6*f*.

Figure 2:
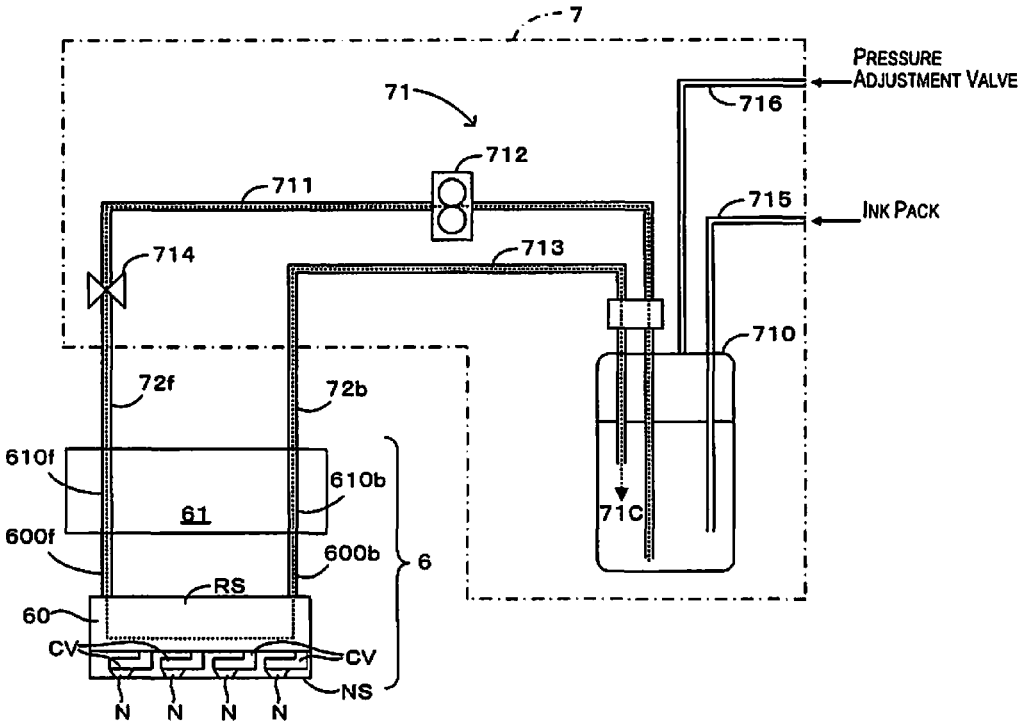
FIG. 2 is a drawing showing a typical example of the ink supply system and the discharge head of the head unit.

Here, we will use FIG. 2 to give a detailed description of the constitution by which the ink supply system supplies ink to the head units. FIG. 2 is a block diagram showing a typical example of the ink supply system and the discharge head of the head unit. The ink supply system 7 has an ink flow control mechanism 71 for each color, but since the constitution of the ink flow control mechanism 71 is the same for each color, we will show as a typical example only one ink flow control mechanism 71 in this drawing. Also, the constitution of the respective head units 6*a* to 6*f* is also the same, so one head unit 6 is shown as a typical example in this drawing. Furthermore, each head unit 6 is provided with a plurality of discharge heads 60 as described later, but since the constitution of each discharge head 60 is the same, one discharge head 60 is shown as a typical example in this drawing.

The discharge head 60 of the head unit 6 has nozzles N that open to a nozzle forming surface NS, a reservoir RS in which ink is temporarily stored, and a cavity CV which allows communication between the nozzles N and the reservoir RS, and ink is supplied to the nozzles N from the reservoir RS via the cavity CV. Also, by the cavity CV adding pressure to the ink, ink is discharged from the nozzles N. Also, the constitution is such that the discharge head 60 has resin tubes 600*f* and 600*b* in communication with the cavity CV, and ink is supplied from the supply tube 600*f* to the cavity CV, and ink is exhausted from the cavity CV to the recovery tube 600*b*.

Furthermore, the head unit 6 has a manifold 61 connected to the discharge head 60. Flow paths 610*f* and 610*b* are formed on the interior of this manifold 61, and the supply flow path 610*f* of the manifold 61 is connected to the supply tube 600*f* of the discharge head 60, and the recovery flow path 610*b* of the manifold 61 is connected to the recovery tube 600*b* of the discharge head 60. Also, with the manifold 61, ink sent from the ink supply system 7 to the supply flow path 610*f* is supplied to the reservoir RS via the supply tube 600*f*, and ink exhausted from the reservoir RS via the recovery tube 600*b* is returned to the ink supply system 7 from the recovery flow path 610*b*.

Incidentally, the manifold 61 and the ink supply system 7 are connected by resin tubes 72*f* and 72*b*. In other words, the supply flow path 610*f* of the manifold 61 is connected to the ink supply system 7 by the supply tube 72*f*, and the recovery flow path 610*b* of the manifold 61 is connected to the ink supply system 7 by the recovery tube 72*b*. Also, ink is sent to the supply flow path 610*f* of the manifold 61 from the ink supply system 7 via the supply tube 72*f*, and ink is returned to the ink supply system 7 from the recovery flow path 610*b* of the manifold 61 via the recovery tube 72*b*.

Also, the ink flow control mechanism 71 built into the ink supply system 7 circulates ink between a tank 710 for storing ink (sub tank) and the discharge head 60. In specific terms, the ink flow control mechanism 71 has a supply flow path 711 that connects the supply tube 72*f* and the tank 710, a circulating pump 712 provided on the supply flow path 711, and a recovery flow path 713 that connects the recovery tube 72*b* and the tank 710. In this way, from the tank 710 to the supply systems 711, 72*f*, 610*f*, and 600*f*, the reservoir RS, the recovery systems 600*b*, 610*b*, 72*b*, and 713, and the tank 710 in this sequence, a circulation path 71C in which ink flows is formed, and by the circulating pump 712 rotating in the forward direction, the ink circulates in the circulation path 71C. In other words, by the circulating pump 712 rotating forward, it is possible to supply ink from the tank 710 to the reservoir RS via the supply systems 711, 72*f*, 610*f*, and 600*f* (forward path), and possible to recover ink from the reservoir RS to the tank 710 via the recovery systems 600*b*, 610*b*, 72*b*, and 713.

Also, the ink flow control mechanism 71 has a valve 714 that opens and closes the supply flow path 711. This valve 714 is provided midway from the circulating pump 712 until reaching the supply tube 72*f* along the circulation path 71C. Therefore, by opening the valve 714, it is possible to execute supplying of ink to the reservoir RS from the tank 710, and by closing the valve 714, it is possible to stop the supplying of ink from the tank 710 to the reservoir RS.

Furthermore, the ink flow control mechanism 71 has an ink supply path 715 for supplying ink (UV ink) to the tank 710 and a pressure adjustment flow path 716 for adjusting the pressure inside the tank 710. The ink supply flow path 715 supplies ink from the ink pack to the tank 710. Incidentally, the ink supplied to the tank 710 has a viscosity of for example approximately 15 mPa.s at 28 to 40 degrees. Also, the pressure adjustment flow path 716 is connected to a pump, and the pressure inside the tank 710 is adjusted by rotating this pump. By doing this, the pressure of the tank 710 can be adjusted respectively to negative pressure, atmospheric pressure, and positive pressure.

We will continue the description while returning to FIG. 1. As described above, the process unit PU is constituted with six head units 6*a* to 6*f*, five UV irradiators 37*a* to 37*e*, and two ink supply systems 7 loaded in the carriage 51. Guide rails 52 are arranged extending in the Y direction respectively facing opposite both end parts of the X direction (conveyance direction Ds) of the carriage 51, and the carriage 51 is stretched across the two rails 52. Therefore, the carriage 51 is able to move in the Y direction on the guide rails 52 along with the head units 6*a* to 6*f*, the UV irradiators 37*a* to 37*e*, and the ink supply systems 7.

Also, with the processing unit 3, the UV irradiator 38 for main curing is provided at the downstream side of the conveyance direction Ds on the head unit 6*f*. Therefore, the clear ink discharged overlapping the color image by the head unit 6*f* undergoes main curing by receiving ultraviolet rays from the UV irradiator 38. The UV irradiator 38 is not installed in the carriage 51.

The sheet S on which a color image is formed by the processing unit 3 is conveyed to the take-up unit 4 by the rear drive roller 32. In addition to the take-up shaft 40 on which the end of the sheet S is wound, this take-up unit 4 has a driven roller 41 on which the sheet S is wound from the back surface side between the take-up shaft 40 and the rear drive roller 32. In a state with the front surface of the sheet S facing the outside, the take-up shaft 40 winds up and supports the end of the sheet S. In other words, when the take-up shaft 40 rotates clockwise on the paper surface in FIG. 1, the sheet S conveyed from the rear drive roller 32 is wound onto the take-up shaft 40 via the driven roller 41. Incidentally, the sheet S is wound onto the take-up shaft 40 via a core tube (not illustrated) that can be attached and detached with the take-up shaft 40. Therefore, it is possible to remove the sheet S for each core tube when the sheet S wound onto the take-up shaft 40 becomes full.

Figure 3:
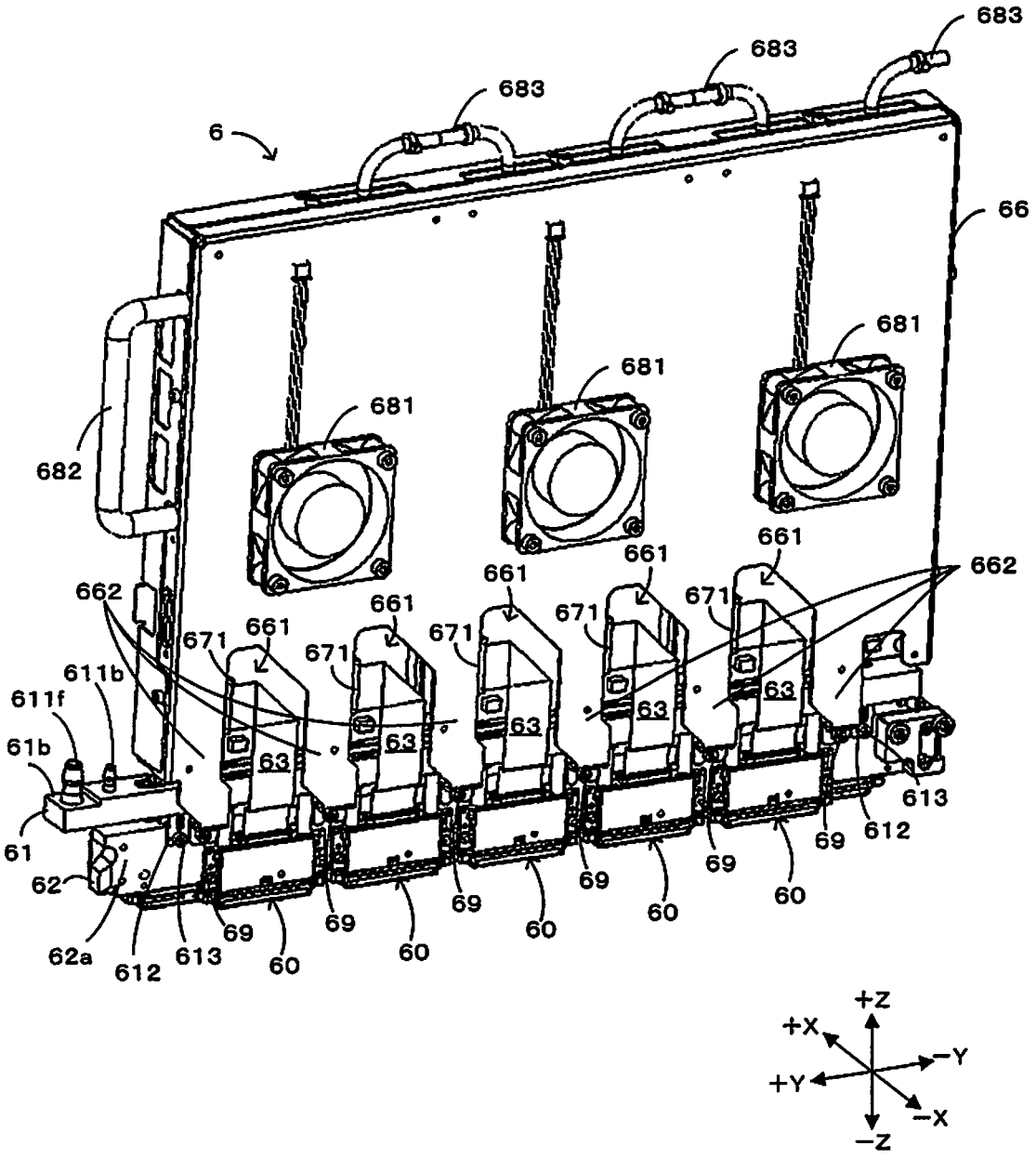
FIG. 3 is a perspective view partially showing an example of the head unit in the assembled state.
Figure 4:
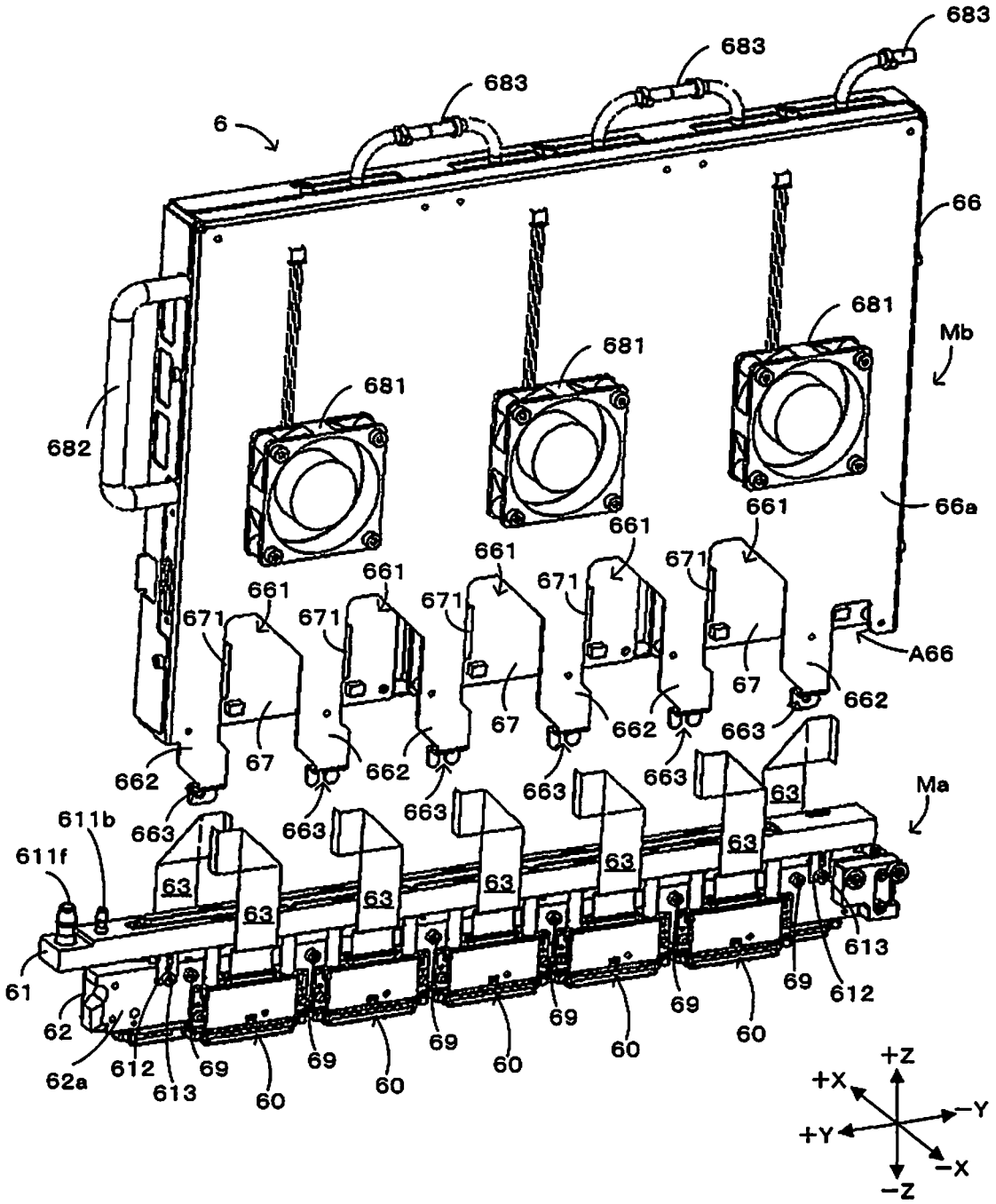
FIG. 4 is a perspective view partially showing an example of the head unit in a disassembled stat.
Figure 5:
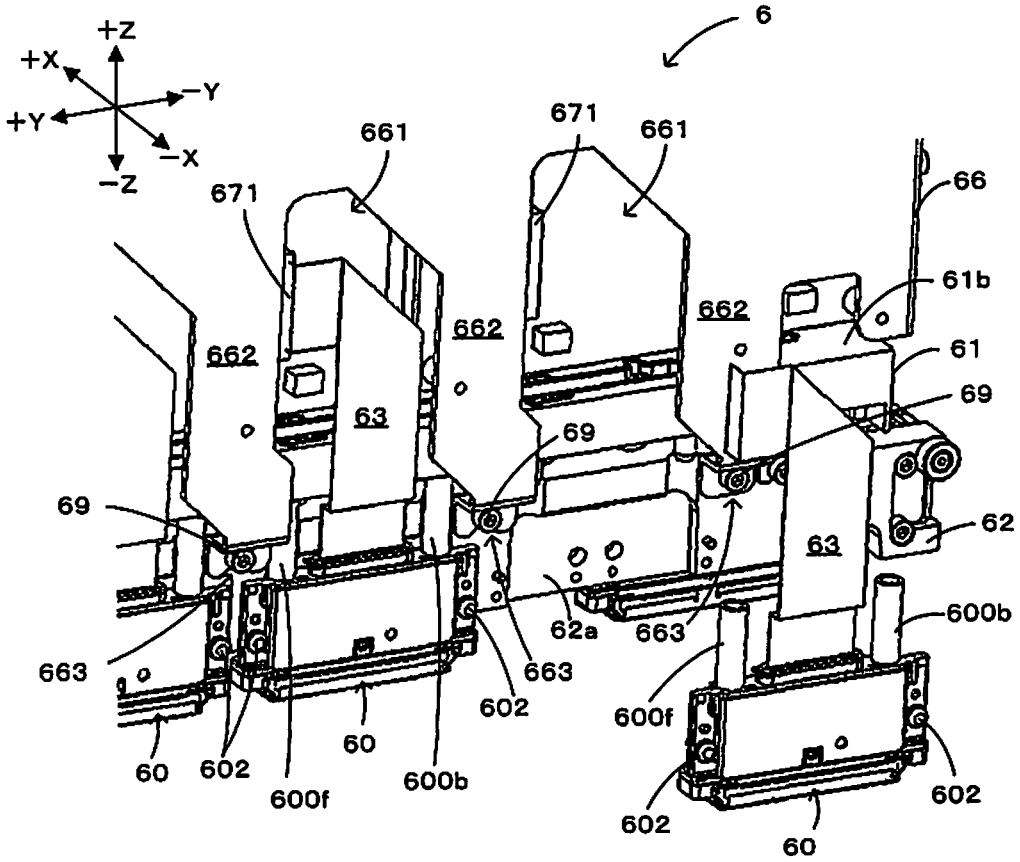
FIG. 5 is a perspective view partially showing an enlarged example of the head unit.

However, the aforementioned head unit 6 is constituted so it is possible to be partially disassembled with manual work by the operator. Next, using FIG. 3, FIG. 4, and FIG. 5, we will give a detailed description of the head unit 6. Here, FIG. 3 is a perspective view partially showing an example of the head unit in the assembled state, and FIG. 4 is a perspective view partially showing an example of the head unit in a disassembled state. FIG. 5 is a perspective view partially showing an enlarged example of the head unit. With these drawings, an example is shown of a case with the head unit 6 standing in the vertical direction Z, but the orientation in which the head unit 6 is arranged is not limited to this example.

The head unit 6 has a roughly rectangular head plate 62 extending in the Y direction. The head plate 62 is formed using metal, for example, and is a rigid member having high rigidity. Also, the plurality of (five with this example) discharge heads 60 arrayed at a designated array pitch in a straight line state in the Y direction are fastened by screws 602 respectively at both side surfaces 62*a* of the X direction of the head plate 62. Therefore, by removing the screws 602 from the head plate 62, it is possible to remove the discharge head 60 from the head plate 62 (example shown at right edge of FIG. 5). The array of the discharge heads 60 at the side surface 62*a* of the −X side of the head plate 62 and the array of discharge heads 60 at the side surface 62*a* of the +X side of the head plate 62 are mutually skewed in the Y direction by half the array pitch of the discharge heads 60. In other words, with the plane view from the Z direction, ten discharge heads 60 are aligned in two rows in zigzag form in the Y direction. Also, at the top side (+Z side) edge of each discharge head 60 is attached a wiring member 63 constituted by an FFC (Flexible flat cable), FPC (Flexible printed circuit) or the like.

At the top side (+Z side) of the head plate 62, the manifold 61 having a roughly rectangular shape extending in the Y direction slightly longer than the head plate 62 is arranged with a gap open from the head plate 62. This manifold 61 has an attachment unit 612 at both sides of the X direction projecting to the lower side (−Z side) at both Y direction end parts, and by fastening each attachment unit 612 to each side surface 62*a* of the head plate 62 using the screws 613, it is possible to attach the manifold 61 to the head plate 62. Therefore, by removing the screws 613 from the head plate 62, it is possible to remove the manifold 61 from the head plate 62.

The manifold 61 has engaging projections 611*f* and 611*b* that project to the top side (+Z side) on the top side (+Z side) surface 61*b*. The engaging projection 611*f* is in communication with the supply flow path 610*f* formed inside the manifold 61, and by having the supply tube 72*f* engage with the engaging projection 611*f*, it is possible to connect the supply tube 72*f* with the supply flow path 610*f*. Also, the engaging projection 611*b* is in communication with the recovery flow path 610*b* formed inside the manifold 61, and by having the recovery tube 72*b* engage with the engaging projection 611*b*, it is possible to connect the recovery tube 72*b* with the recovery flow path 610*b*. The supply flow path 610*f* and the recovery flow path 610*b* are shown simplified in FIG. 2, but in actuality, the supply flow path 610*f* and the recovery flow path 610*b* are provided respectively branched on each discharge head 60.

The manifold 61 is held on the top side (+Z side) of the discharge head 60 by the head plate 62 in this way. Also, the attachment opening of the manifold 61 is engaged with the supply tube 600*f* and the recovery tube 600*b* provided on the discharge head 60 projecting to the top side (+Z side). By doing this, the supply flow path 610*f* of the manifold 61 is connected to the supply tube 600*f* of the discharge head 60, and the recovery flow path 610*b* of the manifold 61 is connected to the recovery tube 600*b* of the discharge head 60. Also, the supply tube 600*f* and the recovery tube 600*b* are engaged so as to be detachable with the attachment opening of the manifold 61, and for example as shown in the right edge of FIG. 5, when the discharge head 60 is removed from the head plate 62, the supply tube 600*f* and the recovery tube 600*b* are removed from the attachment opening of the manifold 61.

Furthermore, the head unit 6 has a roughly rectangular shaped cover frame 66 constituted in a hollow space. This cover frame 66 is constituted using metal, for example, and holds in the interior three electrical circuit substrates 67 aligned in the Y direction. Each electrical circuit substrate 67 generates control signals (electrical signals) for controlling the discharge of the discharge head 60, and outputs those to the discharge head 60. On the side surface 66*a* of the −X side of the cover frame 66 are provided three blowing fans 681 respectively facing opposite the electrical circuit substrate 67, and each blowing fan 681 cools the opposite facing electrical circuit substrate 67. Furthermore, on the cover frame 66 is attached a handle 682 provided at the +Y side edge, or a power cable 683 for supplying power to each electrical circuit substrate 67.

This cover frame 66 has an opening A66 at the bottom side (−Z side), and has a slit 661 arranged on the top side (+Z side) of each discharge head 60 on the side wall 66*a* of the −X side. In this way, five slits 661 are aligned in the Y direction on the side wall 66*a* of the −X side of the cover frame 66. Also, from each slit 661, the attachment opening 671 provided on the electrical circuit substrate 67 is exposed, and it is possible to engage the wiring member 63 so as to be detachable with the attachment opening 671 via the slit 661. In this way, by attaching the attachment opening 671 of the electrical circuit substrate 67 and the wiring member 63 provided extending from the discharge head 60, it is possible to send control signals from the electrical circuit substrate 67 to the discharge head 60 via the wiring member 63.

Also, the attachment unit 662 adjacent to each slit 661 is formed on the side wall 66*a* of the −X side of the cover frame 66. In this way, six attachment units 662 are aligned in the Y direction on the side wall 66*a* of the −X side of the cover frame 66. Each attachment unit 662 has a plate shape extending in the Z direction, and has an engaging hole 663 on the lower side (−Z side). Therefore, as shown in FIG. 3, by screwing the screw 69 engaged with the engaging hole 663 of each attachment unit 662 into the head plate 62, it is possible to fasten the cover plate 66 to the head plate 62 using the screw 69. In a state with the cover frame 66 attached to the head plate 62, the attachment unit 662 of the cover frame 66 is attached to the head plate 62 extending across the manifold 61 in the Z direction, partially hiding the manifold 61. On the other hand, as shown in FIG. 4, it is possible to remove the cover frame 66 from the head plate 62 by removing the screw 69 from the head plate 62.

In this way, the head unit 6 has a head module Ma constituted holding the discharge head 60 and the manifold 61 on the head plate 62, and a substrate module Mb constituted holding the electrical circuit substrate 67 on the cover frame 66. The head module Ma and the substrate module Mb are attached by the screws 69 to be detachable with each other. With that constitution, it is possible to easily execute the attachment work and removal work of the modules Ma and Mb.

In other words, when attaching these, as shown in FIG. 4, the head module Ma is faced opposite the opening A66 of the cover frame 66. Next, with these approaching each other in the Z direction, while the engaging hole 663 provided on the attachment unit 662 of the cover frame 66 is aligned at the screw hole (not illustrated) of the head plate 62, the screw 663 engaged in the engaging hole 663 of both ends in the Y direction is screwed into the head plate 62. Next, the screw 663 engaged in the remaining engaging hole 663 is screwed into the head plate 62. Incidentally, the engaging holes 663 excluding both ends of the Y direction are opened to the bottom side (−Z side), and the constitution is such that it is possible to align them having some play in relation to the screw holes of the head plate 62. Also, in parallel with or after tightening the screws of the engaging holes 663 excluding both ends of the Y direction, the wiring member 63 installed extending from the discharge head 60 is attached via the slit 661 to the attachment opening 671 of the electrical circuit substrate 67. In this way, the work of attaching the modules Ma and Mb is completed. Also, by performing the reverse procedure to the work of attaching the modules Ma and Mb, it is possible to perform the work of removing the modules Ma and Mb.

As described above, with this embodiment, the electrical circuit substrate 67 is held in the cover frame 66, and the discharge head 60 and the manifold 61 are held in the head plate 62. Also, the cover frame 66 and the head plate 62 are attached so as to be detachable using the screws 69. Therefore, it is possible to remove the cover frame 66 and the head plate 62 from each other, and to pull away the discharge head 60 and the manifold 61 held on the head plate 62 from the electrical circuit substrate 67 held in the cover frame 66. As a result, it is possible to perform maintenance on the discharge head 60 and the manifold 61 without interference by the electrical circuit substrate 67, and to improve the efficiency of maintenance work on the discharge head 60 and the manifold 61.

In particular, with this embodiment, for example, it is possible to simultaneously replace the discharge head 60 and the manifold 61 by replacing for each head module Ma. As a result, the trouble of removing the discharge head 60 and the manifold 61 individually is omitted, so it is easier to improve the efficiency of the maintenance operations.

Also, with this embodiment, at least one of the discharge head 60 and the manifold 61 (both with the example noted above) is held so as to be detachable with the head plate 62 by the screws 602 and 613. Therefore, it is possible to separate the discharge head 60 and the manifold 61 from each other, and to execute maintenance on the one without interference by the other. Therefore, this is suitable for improving the efficiency of maintenance work on the discharge head 60 and the manifold 61.

Also, with this embodiment, the wiring member 63 that connects the electrical circuit substrate 67 and the discharge head 60 can be attached and detached with at least one of the discharge head 60 and the electrical circuit substrate 67 (with the example noted above, the electrical circuit substrate 67). Therefore, by removing the wiring member 63 from one of these, it is possible to separate the cover frame 66 and the head plate 62 from each other, and to pull away the discharge head 60 and the manifold 61 held on the head plate 62 from the electrical circuit substrate 67 held in the cover frame 66.

Also, with this embodiment, the cover frame 66 and the head plate 62 are fastened by the screws 69. With that constitution, by removing the screws 69, it is possible to easily remove the cover frame 66 and the head plate 62.

Also, with this embodiment, UV ink cured by irradiation of ultraviolet rays was used. In that case, it is possible that UV ink cured by leaked light or the like will adhere to the discharge head 60 and the manifold 61. In response to this, with this embodiment, it is possible to easily perform maintenance on the discharge head 60 and the manifold 61, and possible to suitably handle the problem of adherence of UV ink.

However, with the example noted above, in a state with the head plate 62 attached to the cover frame 66, the head plate 62 is partially hidden by the cover frame 66 (its attachment unit 662), so if left in this state, there may be cases when maintenance of the manifold 61 cannot be performed efficiently. However, with this embodiment, by separating the cover frame 66 and the head plate 62, it is possible to pull away the manifold 61 from the cover frame 66. As a result, it is possible to perform maintenance work on the manifold 61 efficiently without interference by the cover frame 66.

In this way, with this embodiment, the printer 1 correlates to an example of the "image recording device" of the invention, the head unit 6 correlates to an example of the "head unit" of the invention, the cover frame 66 correlates to an example of the "first holding member" of the invention, the discharge head 60 correlates to an example of the "head" of the invention, the manifold 61 correlates to an example of the "flow path member" of the invention, the head plate 62 correlates to an example of the "second holding member" of the invention, the screw 69 correlates to an example of the "attachment member" of the invention, the wiring member 63 correlates to an example of the "connecting member" of the invention, the rotating drum 30 correlates to an example of the "support unit" of the invention, and the sheet S correlates to an example of the "recording medium" of the invention.

The invention is not limited by the embodiments noted above, and various modifications can be added to the items described above as long as they do not stray from the gist. Therefore, with the embodiment noted above, the cover frame 66 and the head plate 62 were attached so as to be detachable using the screws 69. However, the constitution for attaching these so as to be detachable is not limited to screws, and it is possible to use various latch mechanisms. For the other screws as well, it is also acceptable to modify using various latch mechanisms. Furthermore, for the screw or latch mechanism installation position as well, this is not limited to the examples noted above, and various modifications are possible.

Also, with embodiment noted above, the "flow path member" of the invention was constituted by the manifold 61. However, the constitution for manifesting the "flow path member" is not limited to being the manifold 61. In light of that, it is also possible to constitute the "flow path member" using a bundle of tubes facing the discharge heads 60.

Also, with the embodiment noted above, both the discharge head 60 and the manifold 61 are to be detachable from the head plate 62. However, it is also acceptable to constitute this so that both or one of these is not removed from the head plate 62.

Also, with the embodiment noted above, the wiring member 63 was constituted to be detachable in relation to the discharge head 60. However, it is also possible to constitute the wiring member 63 to be detachable in relation to the electrical circuit substrate 67. Also, with the embodiment noted above, an electrical connection was made between the discharge head 60 and the electrical circuit substrate 67 using a wiring member 63 such as an FFC or the like, but for example it is also possible to constitute this to make an electrical connection between these using a direct connector or the like.

Also, with the embodiment noted above, an example was shown when applying the invention to the printer 1 that supports the sheet S on a cylindrical support unit (rotating drum 30). However, the specific constitution for supporting the sheet S is not limited to this. Therefore, it is also acceptable to have a constitution whereby the sheet S is supported on a flat plane.

Also, the number of, arrangement of, and color discharged by the head units 6*a* to 6*f* or the like can also be changed as appropriate. The number of, arrangement of, and ultraviolet ray strength of the UV irradiators 37*a* to 37*e* and 38 and the like can also be changed as appropriate. Furthermore, the conveyance mode of the sheet S can also be changed as appropriate, and it is also acceptable to constitute such that the sheet S is conveyed by a mode other than the roll to roll mode noted above.

Also, with the embodiment noted above, the invention was applied to the printer 1 equipped with the head units 6*a* to 6*f* that discharge the UV ink. However, it is also acceptable to apply the invention to a printer equipped with a head unit that discharges an ink other than UV ink, such as water based ink such as resin ink or the like, for example. Alternatively, it is also acceptable to apply the invention to a printer that performs printing using an item other than ink.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A head unit comprising:

an electrical circuit substrate;

a first holding member holding the electrical circuit substrate;

a head configured to discharge liquid;

a flow path member having a flow path in which flows the liquid supplied to the head; and a second holding member holding the head and the flow path member, the first holding member and the second holding member being detachably attached with each other, the head being detachably attached to the second holding member in a state where the second holding member holds the flow path member.

2. The head unit according to claim 1, wherein the flow path member is detachably held by the second holding member.

3. The head unit according to claim 1, further comprising a connecting member connecting the electrical circuit substrate and the head, the connecting member configured to transmit electrical signals from the electrical circuit substrate to the head, the connecting member being detachably attached with at least one of the head and the electrical circuit substrate.

4. The head unit according to claim 1, further comprising an attachment member configured to engage with the first holding member and the second holding member, the attachment member being a screw that fastens the first holding member and the second holding member.

5. The head unit according to claim 1, wherein the flow path member is a manifold or a tube.

6. The head unit according to claim 1, wherein the liquid is cured by light irradiation.

7. The head unit according to claim 1, wherein in a state where the first holding member and the second holding member are engaged, the first holding member at least partially hides the flow path member.

8. An image recording device comprising:

a support unit configured to support a recording medium; and a head unit configured to discharge liquid on the recording medium supported by the support unit, the head unit including an electrical circuit substrate, a first holding member holding the electrical circuit substrate, a head configured to discharge liquid, a flow path member having a flow path in which flows the liquid supplied to the head, and a second holding member holding the head and the flow path member, the first holding member and the second holding member being detachably attached with each other, the head being detachably attached to the second holding member in a state where the second holding member holds the flow path member.

9. A head unit comprising:

an electrical circuit substrate;

a first holding member holding the electrical circuit substrate;

a head configured to discharge liquid;

a flow path member having a flow path in which flows the liquid supplied to the head; and a second holding member holding the head and the flow path member, the first holding member and the second holding member being detachably attached with each other, the flow path member being detachably attached to the second holding member such that the flow path member is apart from the second holding member while the head is attached and contacted to the second holding member and the first holding member and the second holding member are apart from each other.

10. The head unit according to claim 9, further comprising a connecting member connecting the electrical circuit substrate and the head, the connecting member configured to transmit electrical signals from the electrical circuit substrate to the head, the connecting member being detachably attached with at least one of the head and the electrical circuit substrate.

11. The head unit according to claim 9, further comprising an attachment member configured to engage with the first holding member and the second holding member, the attachment member being a screw that fastens the first holding member and the second holding member.

12. The head unit according to claim 9, wherein the flow path member is a manifold or a tube.

13. The head unit according to claim 9, wherein the liquid is cured by light irradiation.

14. The head unit according to claim 9, wherein in a state where the first holding member and the second holding member are engaged, the first holding member at least partially hides the flow path member.

* * * * *